US009188141B2

(12) United States Patent
Yokota

(10) Patent No.: US 9,188,141 B2
(45) **Date of Patent: *Nov. 17, 2015**

(54) CYLINDER DEVICE WITH FORCE MULTIPLIER

(71) Applicant: Kosmek Ltd., Hyogo (JP)

(72) Inventor: Hideaki Yokota, Hyogo (JP)

(73) Assignee: Kosmek Ltd., Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/627,088

(22) Filed: Feb. 20, 2015

(65) Prior Publication Data

US 2015/0159680 A1 Jun. 11, 2015

Related U.S. Application Data

(62) Division of application No. 13/878,886, filed as application No. PCT/JP2011/006114 on Nov. 1, 2011, now Pat. No. 9,133,866.

(30) Foreign Application Priority Data

Nov. 24, 2010 (JP) ..... 2010-277451

(51) Int. Cl.
*F15B 15/26* (2006.01)
*B25B 5/06* (2006.01)
(Continued)

(52) U.S. Cl.
CPC ..... *F15B 15/261* (2013.01); *B25B 5/062* (2013.01); *B25B 5/064* (2013.01); *B25B 5/16* (2013.01); *F02F 1/00* (2013.01)

(58) Field of Classification Search
CPC ..... B23Q 3/082; B23Q 3/06; B25B 5/16; B25B 5/062; B25B 5/064; F15B 15/261
USPC ..... 92/15
See application file for complete search history.

(56) References Cited

U.S. PATENT DOCUMENTS

| | | | | |
|---|---|---|---|---|
| 4,881,745 | A | 11/1989 | Peters | |
| 6,394,437 | B1 * | 5/2002 | Yonezawa | 269/32 |
| 7,175,169 | B2 * | 2/2007 | Yonezawa | 269/32 |

FOREIGN PATENT DOCUMENTS

| | | | |
|---|---|---|---|
| JP | 200125932 | A | 1/2001 |
| JP | 2007268625 | A | 10/2007 |
| JP | 2009255219 | A | 11/2009 |

OTHER PUBLICATIONS

Japanese Office Action of JP2010-277451 (5-1: Notification of reasons for refusal 5-2: Decision to Grant a Patent) Dated Dec. 5, 2011 and Feb. 23, 2012.

(Continued)

*Primary Examiner* — Thomas E Lazo
(74) *Attorney, Agent, or Firm* — Bacon & Thomas, PLLC

(57) ABSTRACT

A first piston (21) is coupled to an output rod (2) inserted in a housing (1). A second piston (22) is inserted in the housing (1) radially outside of the output rod (2). A force multiplier (36) has a wedge space (39) and a plurality of engaging balls (40). When force multiplication driving is started, the wedge space (39) is formed between a transmitting portion (37) provided in the output rod (2) and a receiving portion (38) provided in the housing (1) so as to get narrower as it extends radially inward. Before the force multiplication driving is started, the engaging balls (40) are brought into contact with an outer circumferential surface of the output rod (2), and when the force multiplication driving is started, the engaging balls (40) are pushed out toward the wedge space (39) to engage with the transmitting portion (37).

13 Claims, 5 Drawing Sheets

(51) Int. Cl.
*B25B 5/16* (2006.01)
*F02F 1/00* (2006.01)

(56) References Cited

OTHER PUBLICATIONS

Japanese Office Action of JP2012-028741 (6-1: Decision to Grant a Patent) Dated Jun. 15, 2012.

Japanese Office Action of JP2012-028742 (7-1: Notification of reasons for refusal 7-2: Decision to Grant a Patent) Dated Jun. 15, 2011 and Oct. 1, 2012.

English language translation of International Preliminary Report on Patentability dated Mar. 24, 2013.

* cited by examiner

CYLINDER DEVICE WITH FORCE MULTIPLIER

TECHNICAL FIELD

The present invention relates to a cylinder device with a force multiplier and, more specifically, to a technology suitable to strongly fixing an object to be fixed such as a workpiece or a mold and retaining its fixed state.

BACKGROUND ART

Such a type of conventional cylinder device with a force multiplier is disclosed in Patent Literature 1 (Japanese Patent Application Publication, Tokukai, No. 2007-268625 A). The conventional technology is configured as follows:

A clamping rod serving as an output rod is inserted in a housing so as to be movable vertically. A first piston for rod is inserted in an upper part of the housing, and is fixed to the clamping rod. A first lock chamber and a first release chamber are formed above and below the first piston, respectively. A second piston for force multiplication is inserted in a lower part of the housing, and is fitted on the clamping rod so as to be movable vertically. A second lock chamber and a second release chamber are formed above and below the second piston, respectively.

In a case where the clamping rod is subjected to lock driving, the first piston and the second piston are driven downward by supplying compressed air into the first lock chamber and the second lock chamber. This first causes the first piston to drive the clamping rod downward during a low-load stroke of the lock driving, and then causes the second piston to drive the clamping rod in a force-multiplying manner via a force multiplier during a high-load stroke that follows the low-load stroke.

Conventionally, the force multiplier includes: an engagement groove provided in a lower portion of the clamping rod; and a plurality of claw members swingably supported by the lower part of the housing. During the force multiplication driving, a tapered surface of the second piston, which has been driven downward, causes the claw members to swing radially inward, so that the claw members engage with the engagement groove.

CITATION LIST

Patent Literature 1

Japanese Patent Application Publication, Tokukai, No. 2007-268625 A

SUMMARY OF INVENTION

Technical Problem

Since the conventional technology employs a force multiplier of a type in which the claw members are swung, the outer dimensions of the force multiplier are great, resulting in a bulky cylinder device.

It is an object of the present invention to provide a small-sized cylinder device with a force multiplier.

Solution to Problem

In order to attain the foregoing object, a cylinder device with a force multiplier below of the present invention is configured as shown in FIGS. 1A through 1D, FIG. 2, or FIGS. 3A through 3D.

The cylinder device with a force multiplier includes (i) an output rod 2 inserted in a housing 1 so as to be movable axially, (ii) a first piston 21 coupled to the output rod 2 in the housing 1, (iii) a second piston 22 inserted in the housing 1 radially outside of the output rod 2 so as to be movable axially, and (iv) the force multiplier 36 causing an axial force acting on the second piston 22 to be subjected to force multiplication so as to be transmitted to a transmitting portion 37 of the output rod 2. The force multiplier 36 has a wedge space 39 and a plurality of engaging members 40. When force multiplication driving is started by the first piston 21 and the second piston 22 axially moving relative to each other, the wedge space 39 is formed between the transmitting portion 37 of the output rod 2 and a receiving portion 38 provided in the housing 1 so as to get narrower as it extends radially inward. Before the force multiplication driving is started, the engaging members 40 are brought into contact with a portion of an outer circumferential surface of the output rod 2 excluding the transmitting portion 37, and when the force multiplication driving is started, the engaging members 40 are pushed out toward the wedge space 39 by the second piston 22.

Since, unlike the swing-type force multiplier of the conventional technology, the present invention employs a wedge-type force multiplier having a wedge space, the outer dimensions of the force multiplier are small, making it possible to provide a small-sized cylinder device.

It is preferable that the present invention further include the following configuration:

The second piston 22 is arranged in the housing 1 in tandem with the first piston 21. The force multiplier 36, during its force multiplication driving, causes (i) a first force, with which the second piston 22 is moved toward a first axial end side, to be reversed to be a second force getting toward a second axial end side and (ii) the second force to be subjected to force multiplication so as to be transmitted to the transmitting portion 37. The engaging members 40 are configured to be switchable between a state in which the engaging members 40 are engaged on the transmitting portion 37 during the force multiplication driving and a state in which the engaging members 40 are brought into contact with a portion of the outer circumferential surface of the output rod 2 that is closer to the second axial end side than the transmitting portion 37 during a low-load stroke before the force multiplication driving is started.

Further, it is preferable that the present invention further include the following configuration:

The second piston 22 is arranged in the housing 1 in tandem with the first piston 21. The force multiplier 36, during its force multiplication driving, causes (i) a first force, with which the second piston 22 is moved toward a first axial end side, to be reversed to be a second force getting toward a second axial end side and (ii) the second force to be subjected to force multiplication so as to be transmitted to the transmitting portion 37. The second piston 22 is provided with a press portion 48 for pushing out the engaging members 40 toward the wedge space 39 at a start of the force multiplication driving, the press portion 48 pushing the engaging members 40 radially inward and toward a portion of the outer circumferential surface of the output rod 2 that is closer to the second axial end side than the transmitting portion 37 during a low-load stroke before the force multiplication driving is started.

In the present invention, it is preferable that the plurality of engaging members 40 be inserted at regular intervals circumferentially in the wedge space 39.

Further, in the present invention, it is preferable that the engaging members 40 are balls.

Furthermore, the present invention is preferably configured to further include a specific component(s) described in each of the embodiments to be described.

BRIEF DESCRIPTION OF DRAWINGS

FIG. 1A is an elevational cross-sectional view of a cylinder device in a release state. FIG. 1B, which is similar to FIG. 1A, shows a state of the cylinder device at a final stage of a low-load stroke in lock driving of the cylinder device. FIG. 1C, which is similar to FIG. 1A, shows an initial state of force multiplication driving of the cylinder device. FIG. 1D, which is similar to FIG. 1A, shows a locked state of the cylinder device at a final stage of force multiplication driving.

FIG. 3A, which is similar to FIG. 1A, shows a retreating state of a swivel clamping member provided in a cylinder device. FIG. 3B, which is equivalent to a state that is between the state shown in FIG. 1A and the state shown in FIG. 1B, shows a state of the clamping member having finished swiveling in lock driving of the cylinder device. FIG. 3C, which is similar to FIG. 1C, shows a state of the clamping member getting ready to be locked. FIG. 3D, which is similar to FIG. 1D, shows a locked state of the clamping member.

DESCRIPTION OF EMBODIMENTS

Figure 1D:
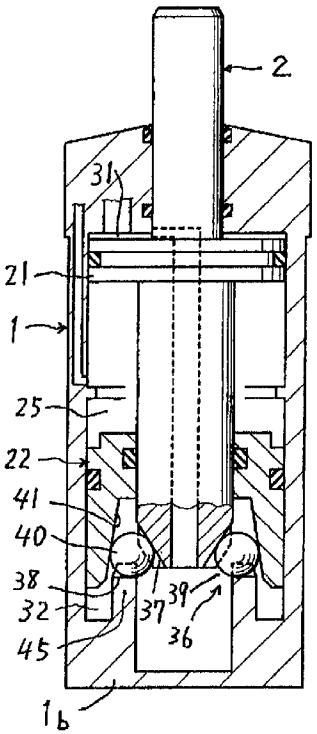
FIGS. 1A through 1D are schematic views showing a first embodiment of the present invention.

FIGS. 1A through 1D are schematic views showing a first embodiment of the present invention.

A structure of a cylinder device with a force multiplier will be first described with reference to FIG. 1A, which shows the cylinder device in a release state.

An output rod 2 is inserted in a housing 1 so as to be movable vertically. The housing 1 has an upper end wall (first end wall) 1*a* in which an upper hole 5 is provided, and has a lower end wall (second end wall) 1*b* in which a lower hole 7 is provided. The output rod 2 has an upper rod part 2*a* hermetically supported in the upper hole 5 via a sealing member 6. The output rod 2 has a lower rod part 2*b* supported in the lower hole 7 and is formed to be larger in diameter than the upper rod part 2*a*.

The housing 1 has a barrel part 1*c*. In the barrel part 1*c*, a first cylinder hole 11 and a second cylinder hole 12 are provided so that the first cylinder hole 11 is above the second cylinder hole 12, i.e., so that the second cylinder hole 12 is below the first cylinder hole 11. A first piston 21 for rod is hermetically inserted in the first cylinder hole 11 via a sealing member 14, and is fixed on the output rod 2. A second piston 22 for force multiplication is hermetically inserted in the second cylinder hole 12 via an outer sealing member 16, and is fitted on the output rod 2 via an inner sealing member 17 so as to be movable vertically.

Arranged between the first piston 21 and the second piston 22 is a lock chamber 25 into and out of which compressed air for locking can be supplied and discharged, via a lock supply and discharge passage 26 and a lock port (not illustrated).

A first release chamber 31 is arranged above the first piston 21, and a second release chamber 32 is arranged below the second piston 22. The first release chamber 31 and the second release chamber 32 communicate with each other via a communicating hole 34 formed in the output rod 2. This allows compressed air for releasing to be supplied into and discharged out of the first release chamber 31 and the second release chamber 32, via a release supply and discharge passage 27 and a release port (not illustrated).

In the second release chamber 32, the output rod 2 and the second piston 22 are provided with a force multiplier 36. The force multiplier 36 is configured such that a force, with which compressed air supplied into the lock chamber 25 pushes the second piston 22 downward, is (i) reversed to be a force exerted upward in a force-multiplying manner, and is (ii) then transmitted to the output rod 2.

Figure 1C:
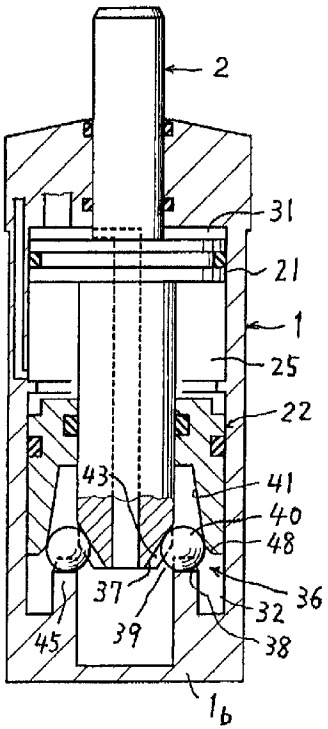
Figure 2:
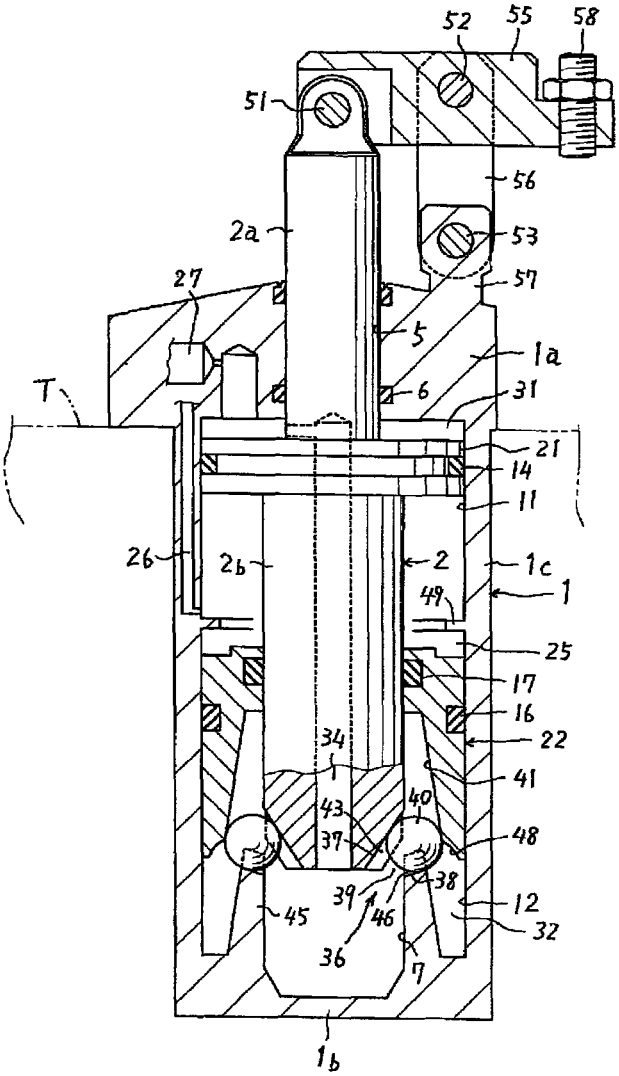
FIG. 2, which is equivalent to FIG. 1C, shows a cylinder device according to a second embodiment of the present invention.

The force multiplier 36 is configured as shown in FIG. 1C or FIG. 2 (initial state of force multiplication driving) which will be described later. That is, the force multiplier 36 has a wedge space 39 which has an annular shape and which is formed between transmitting portions 37 provided at a lower end of the lower rod part 2*b* and receiving portions 38 provided in the lower end wall 1*b*, during the force multiplication driving, so as to get narrower as it extends radially inward. A plurality of engaging balls (engaging members) 40 put in the wedge space 39 at predetermined intervals circumferentially. A force-multiplying portion 41 is provided in the second piston 22 so as to push the engaging balls 40 radially inward. In further detail, each of these components is configured as below.

According to the first embodiment, four depressions 43 are provided, at substantially regular intervals along the circumferential direction, in an outer circumferential surface of the lower end of the lower rod part 2*b*. The depressions 43 have bottom walls that constitute the respective transmitting portions 37. Each of the transmitting portions 37 has a slope that gets closer to an axis of the output rod 2 as it extends downward.

Four transverse grooves 46 are provided circumferentially on top of a cylindrical part 45 projecting upward from the lower end wall 1*b* of the housing 1. The transverse grooves 46 have bottom walls that constitute the respective receiving portions 38.

The force-multiplying portion 41 is constituted by an inclined surface formed by an inner circumferential surface of the second piston 22. There is provided, below the force-multiplying portion 41, a press portion 48 that continues into the force-multiplying portion 41. The press portion 48 will be described later. The press portion 48 here is constituted by an inclined surface.

Figure 1B:
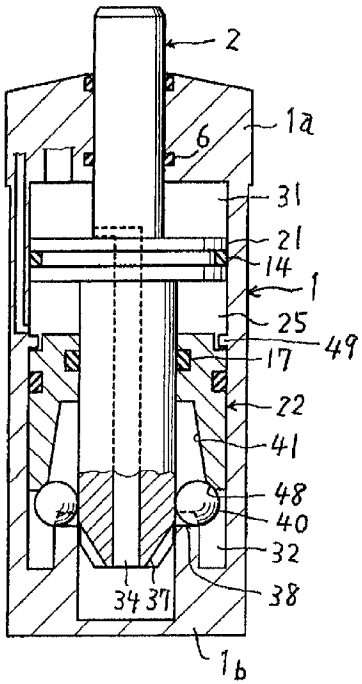
Figure 1A:
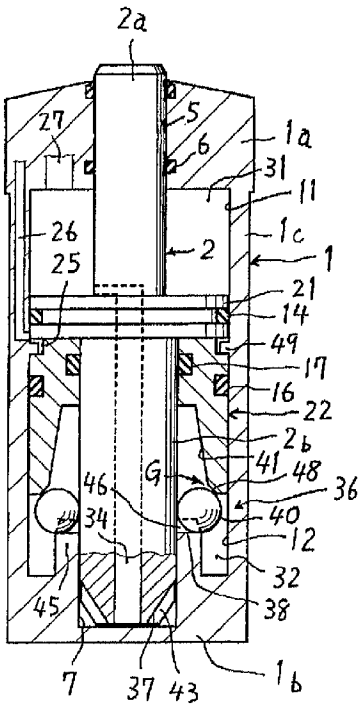

The cylinder device thus configured operates as follows:

In the release state shown in FIG. 1A, compressed air is discharged out of the lock chamber 25, and compressed air is supplied into the first release chamber 31 and the second release chamber 32. This causes (i) the compressed air in the second release chamber 32 to push the second piston 22 upward and (ii) the compressed air in the first release chamber 31 to push the first piston 21 downward.

In this case, a difference between an upward force acting on the second piston 22 and a downward force acting on the first piston 21 causes (i) a peripheral portion of an upper surface of the second piston 22 to be received by a stopper 49 provided at a certain height of the barrel part 1*c* of the housing 1 and (ii) a lower surface of the first piston 21 to be received by a central portion of the upper surface of the second piston 22. A predetermined gap G is formed between the press portion 48 of the second piston 22 and the engaging balls 40.

In a case where the cylinder device is subjected to lock driving, (i) the compressed air is discharged out of the first release chamber 31 and the second release chamber 32 and (ii) compressed air is supplied into the lock chamber 25, in the release state shown in FIG. 1A.

Then, the compressed air in the lock chamber 25 pushes the first piston 21 upward and pushes the second piston 22 downward. This causes, as shown in FIG. 1B (a final stage of a low-load stroke in lock driving), the press portion 48 of the second piston 22 (i) to be received by the receiving portions 38 of the lower end wall 1*b* via the engaging balls 40 and (ii) to push the engaging balls 40 radially inward, i.e., toward an outer circumferential surface of the output rod 2, so that the engaging balls 40 make contact with the outer circumferential surface. The compressed air in the lock chamber 25 causes the output rod 2 to move up, via the first piston 21, against a low-load caused by a frictional force generated by the contact, a frictional force generated by the sealing members 6, 14 and 17, and the like.

As the output rod 2 moves up, (i) the wedge space 39 is formed between the transmitting portions 37 provided in a lower portion of the output rod 2 and the receiving portions 38 provided in the lower end wall 1*b* (see FIG. 1C) and (ii) the press portion 48 pushes out the engaging balls 40 toward the wedge space 39. It is now possible to start force multiplication driving.

Next, as shown in FIG. 1C (initial state of force multiplication driving), the output rod 2 further moves up, and causes an upper end of the output rod 2 to be received by a workpiece (not illustrated) so that a high load acts on the output rod 2, and the force-multiplying portion 41 of the second piston 22 pushes out the engaging balls 40 radially inward. This causes a downward thrust acting on the second piston 22 to be transformed, in a force-multiplying manner, into an upward force, via the force-multiplying portion 41, the engaging balls 40, the receiving portions 38, and the transmitting portions 37. In consequence, the output rod 2 is strongly driven upward.

Then, as shown in FIG. 1D (locked state at a final stage of force multiplication driving), the second piston 22 pushes, upward via the force multiplier 36, the output rod 2 which has been received by the workpiece (not illustrated) and is therefore prevented from moving up. This causes the output rod 2 to be strongly pushed upward by a resultant of (i) an upward force exerted by the force multiplier 36 and (ii) an upward force exerted by the first piston 21.

Note that, in a case where the force multiplier 36 has a coefficient of friction of 0.08 to 0.15, the "upward force exerted by the force multiplier 36" is approximately 2 to 3.5 times as strong as a "downward thrust of the second piston 22".

Note also that, in the locked state shown in FIG. 1D, a retaining force exerted by the force multiplier 36 (i.e., a force with which an external force acting on the output rod 2 prevents the locked state from being released) is approximately 5 to 10 times as strong as the "downward thrust of the second piston 22". This makes it possible to mechanically and strongly retain the locked state.

The downward thrust of the second piston 22 is reversed to be an upward thrust, via the force-multiplying portion 41, the engaging balls 40, the receiving portions 38, and the transmitting portions 37, and then the upward thrust is transmitted to the output rod 2. Therefore, a great reaction force, generated during force multiplication driving, acts as compressive force from the output rod 2 onto the lower end wall 1*b* of the housing 1, via the engaging balls 40 and the receiving portions 38. Accordingly, as is clear from FIG. 1D, such a great reaction force generated during force multiplication driving can be received by a simple structure in which the lower end wall 1*b* is provided with the cylindrical part 45 by which the compressive force is received. This makes it possible, as a result, to provide a small-sized cylinder device.

Furthermore, an angle of inclination between the press portion 48 and the axis of the output rod 2 is set to be greater than an angle of inclination between the force-multiplying portion 41 and the axis of the output rod 2. As such, a force with which the press portion 48 pushes the engaging balls 40 radially inward is smaller than a force with which the force-multiplying portion 41 pushes the engaging balls 40 radially inward. Since this causes, during the low-load stroke, a reduction in the frictional force generated by the contact between the outer circumferential surface of the output rod 2 and the engaging balls 2, the output rod 2 can smoothly move up.

In a case where the cylinder device is changed from the locked state shown in FIG. 1D to the release state shown in FIG. 1A, (i) the compressed air is discharged out of the lock chamber 25 and (ii) compressed air is supplied into the first release chamber 31 and the second release chamber 32, in the locked state shown in FIG. 1D.

In such a case, the compressed air in the release chamber 32 first causes the second piston 22 to move up with respect to the output rod 2 which has been prevented by the engaging balls 40 from moving down, and when the second piston 22 further moves up, the engaging balls 40 is caused to be changed to the state shown in FIG. 1B via the state shown in FIG. 1C. It is therefore possible to move down the output rod 2 and the first piston 21. Subsequently, the second piston 22, which has been moved up by the compressed air supplied into the second release chamber 32, is received by the stopper 49. After that, the first piston 21 causes the output rod 2 to move down. This ultimately causes the lower surface of the first piston 21 to make contact with the upper surface of the second piston 22 (see FIG. 1A (release state)).

At a termination stage of the moving down of the output rod 2, the aforementioned gap G, shown in FIG. 1A, is formed between the press portion 48 of the second piston 22 and the engaging balls 40. As such, there is little frictional force acting between the outer circumferential surface of the output rod 2 and the engaging balls 40. This allows the output rod 2 to smoothly move down.

In the first embodiment, examples of shapes of (i) the depressions 43 constituting the transmitting portions 37 and (ii) the transverse grooves 46 constituting the receiving portions 38 can encompass the shapes of a circular arc groove, a U-shaped groove, and a Gothic-arched groove. In this regard, the same applies to another embodiment and a modification that will be described later.

Figure 4:
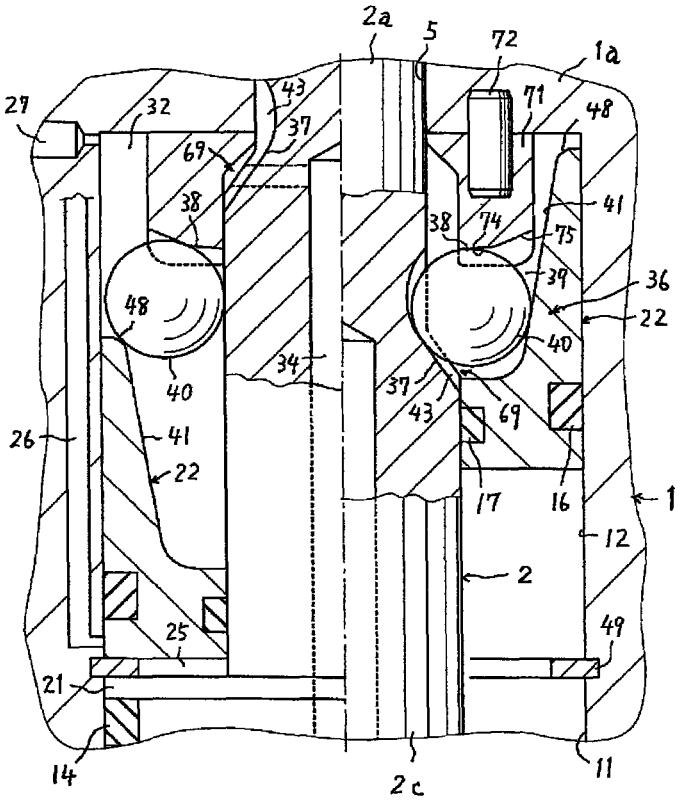
FIG. 4 is an enlarged view of a force multiplier provided in the third embodiment, the left half of FIG. 4 showing a release state, the right half of FIG. 4 showing a locked state.
Figure 5:
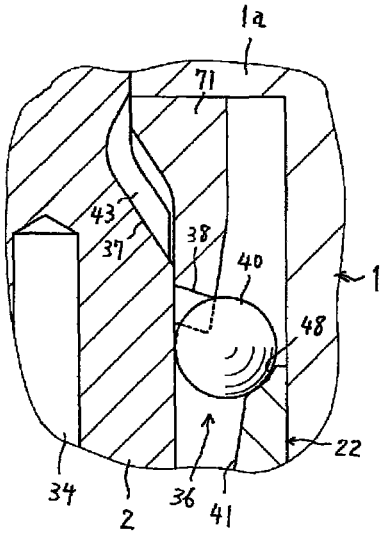
FIG. 5, which is equivalent to the release state shown in the left half of FIG. 4, shows a modification of the force multiplier.

FIG. 2 shows a second embodiment of the present invention. FIG. 3A through FIG. 3D and FIG. 4 show a third embodiment of the present invention. FIG. 5 shows a modification of the force multiplier. In descriptions of the second and third embodiments and the modification, components identical (or similar) to the components described in the first embodiment will be given identical reference numerals and/or signs.

The second embodiment shown in FIG. 2 is an example cylinder device having a link clamping mechanism for fixing a workpiece (not illustrated). FIG. 2, which is equivalent to FIG. 1C, shows an initial state of force multiplication driving of the cylinder device.

The second embodiment shown in FIG. 2 differs from the first embodiment in terms of the following points.

The housing 1 is attached to a fixed base T such as a table. The output rod 2 has an upper portion (i) projecting upward from the upper end wall (first end wall) 1*a* of the housing 1 and (ii) supporting a left end of a clamping member 55 via a first pin 51 so that the clamping member 55 is vertically rotatable. A link member 56 has an upper portion which is rotatably supported, via a second pin 52, by a crosswise intermediate portion of the clamping member 55. The link member 56 has a lower portion which is rotatably supported by a supporting portion 57 via a third pin 53. The supporting portion 57 projects upward from the upper end wall 1*a*.

The press portion 48, provided as a lower portion of the second piston 22, is constituted by a circular arc surface in section, instead of the inclined surface of the first embodiment. The receiving portions 38, provided as an upper portion of the lower end wall (second end wall) 1*b* of the housing 1, are constituted by bottom walls of respective inclined grooves and each have a slope that gets closer to the axis of the output rod 2 as it extends downward.

In a case where the cylinder device is subjected to lock driving, as shown in FIG. 2, compressed air in the lock chamber 25 first causes the first piston 21 to move up the output rod 2. This causes (i) the force multiplier 36 to be changed to an initial state of force multiplication driving and (ii) the clamping member 55 to be rapidly rotated clockwise. And, when a push bolt 58, provided at a right end of the clamping member 55, makes contact with an upper side of a workpiece (not illustrated) so that a high load acts on the output rod 2, the compressed air in the lock chamber 25 strongly pushes up the output rod 2 via the second piston 22 and the engaging balls 40 of the force multiplier 36. This causes the clamping member 55 to be strongly driven clockwise.

It should be noted that as explained above in the first embodiment, release driving of the cylinder device is carried out by executing the steps of the procedure for lock driving in reverse order.

The second embodiment can be altered as follows.

Specifically, the output rod 2 has a lower portion projecting downward from the lower end wall 1*b*, and the projecting portion is hermetically inserted in the lower end wall 1*b*. Moreover, the projecting portion has a lower part coupled to a detected part via which an operating state of the cylinder device is detected by a sensor which faces the detected part. An example of the sensor is a limit switch.

A third embodiment shown in FIGS. 3A through 3D and FIG. 4 is an example cylinder device having a swivel clamping mechanism for fixing an object to be fixed (not illustrated) such as a workpiece.

A structure of the cylinder device will be first described with reference to FIG. 3A (release state).

The housing 1 has a barrel part 1*c*. The barrel part 1*c* has a first cylinder hole 11 and a second cylinder hole 12 formed so that the second cylinder hole 12 is located above the first cylinder hole 11. A first piston 21 for rod is inserted in the first cylinder hole 11 and a second piston 22 for force multiplication is inserted in the second cylinder hole 12. A first release chamber 31 is arranged below the first piston 21, and a second release chamber 32 is arranged above the second piston 22. The force multiplier 36 is arranged in the second release chamber 32.

That is, according to the third embodiment, the first piston 21, the second piston 22, and the force multiplier 36 are provided upside down, as compared with those of the first and second embodiments.

More specifically, in the drawings of the first and second embodiments, the output rod 2 has one axial end side serving as a first end side and the other axial end side serving as a second end side, with the first end side above the second end side, i.e., with the second end side below the first end side. In contrast, in the drawings of the third embodiment, the output rod 2 has one axial end side serving as a first end side and the other axial end side serving as a second end side, with the first end side below the second end side, i.e., with the second end side above the first end side.

The housing 1 has a lower end wall (first end wall) 1*b* in which a lower hole 7 is provided, and has an upper end wall (second end wall) 1*a* in which an upper hole 5 is provided. The output rod 2 has a lower rod part 2*b* so supported in the lower hole 7 as to be movable vertically and rotatable on its axis. The output rod 2 has an upper rod part 2*a* so hermetically supported in the upper hole 5 as to be movable vertically and rotatable on its axis. The output rod 2 has a projecting portion projecting upward from the upper end wall 1*a*, with a clamping member 55 (see FIGS. 3B through 3D) attached to the projecting portion by a nut 61, the clamping member 55 being constituted by a cantilever arm.

It should be noted that the output rod 2 has a rod main body 2*c* formed to be larger in diameter than the upper rod part 2*a*.

A guide mechanism 62 is provided for the lower end wall 1*b* and the lower rod part 2*b*. The guide mechanism 62 is of a publicly known structure configured as follows (for example, see Japanese Patent Application Publication, Tokukai, No. 2004-1163 A):

The lower rod part 2*b* has a plurality of guide grooves 63 which (only one of which is illustrated here) are arranged at regular intervals circumferentially. Each of the guide grooves 63 is constituted by helical swivel grooves 63*a* and a straight groove 63*b* which are vertically concatenated so that the straight groove 63*b* is located above the helical swivel grooves 63*a* (see FIG. 3B). Guide balls 64 fitted in the respective guide grooves 63 are inserted in through-holes 66 of a cylindrical member 65 which projects upward from the lower end wall 1*b*. A rotating sleeve 67 is fitted on the plurality of guide balls 64.

As shown mainly in the enlarged view of FIG. 4, the force multiplier 36 is configured as follows. Note that the left half of FIG. 4 shows a release state and the right half of FIG. 4 shows a locked state.

The transmitting portions 37 are formed in a stepped portion 69 provided between the upper rod part 2*a* and the rod main body 2*c*. That is, four depressions 43 (only one of which is illustrated in FIG. 4) are formed in the stepped portion 69 at substantially regular intervals circumferentially, and the bottom walls of the depressions 43 constitute the respective transmitting portions 37. Each of the transmitting portions 37 is inclined so as to get closer to the axis of the output rod 2 as it extends upward.

Furthermore, in the upper end wall (second end wall) 1*a* of the housing 1, a receiving sleeve 71 is stopped by a pin 72 from rotating. The receiving portions 38 are formed in a lower part of the receiving sleeve 71. The receiving portions 38 are each constituted by a bottom wall of a groove. Moreover, each of the receiving portions 38 has an inner inclined wall 74 and an outer inclined wall 75 both of which get closer to the axis of the output rod 2 as they extend downward.

Note that the stopper 49 provided in the barrel part 1*c* of the housing 1 is constituted by a retaining ring.

Figure 3A:
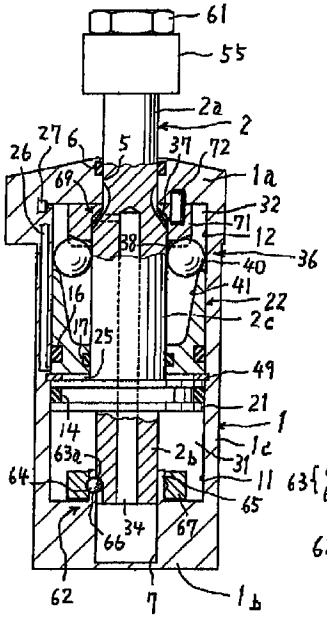
FIGS. 3A through 3D show a third embodiment of the present invention.

The cylinder device thus configured operates as follows:

In the release state shown in FIG. 3A, compressed air is discharged out of the lock chamber 25, and compressed air is supplied into the first release chamber 31 and the second release chamber 32. This causes (i) the compressed air in the second release chamber 32 to push the second piston 22 downward, and (ii) the compressed air in the first release chamber 31 to push the first piston 21 upward.

This causes the clamping member 55 to be changed to a retreating state by swiveling.

In a case where the cylinder device is subjected to lock driving, (i) the compressed air is discharged out of the first release chamber 31 and the second release chamber 32 and (ii) compressed air is supplied into the lock chamber 25, in the release state shown in FIG. 3A.

Figure 3B:
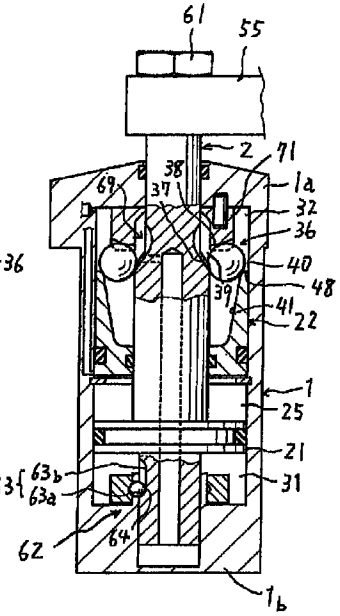

Then, the compressed air in the lock chamber 25 pushes (i) the first piston 21 downward so as to cause the output rod 2 to move down with a low-load and (ii) the second piston 22 upward. In response thereto, as shown in FIG. 3B, (i) the guide balls 64 cause the output rod 2 and the clamping member 55 to move down with a low load, while swiveling them via the helical grooves 63*a* and (ii) the wedge space 39 concurrently starts to be formed between the transmitting portions 37 provided in the stepped portion 69 of the output rod 2 and the receiving portions 38 provided in the receiving sleeve 71.

Figure 3C:
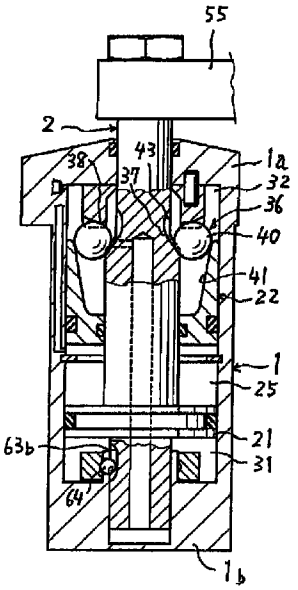

Next, as shown in FIG. 3C (initial state of force multiplication driving), the guide balls 64 causes the output rod 2 to move straight down, via the straight grooves 63*b* of the guide grooves 63, with a low load. And, when a high load acts on the output rod 2 because a lower surface of a right portion of the clamping member 55 is received by a workpiece (not illustrated), an upward thrust of the second piston 22 causes the force-multiplying portion 41 to push the engaging balls 40 radially inward. This causes the upward thrust of the second piston 22 to be subjected to a force-multiplying transformation in which the upward thrust is transformed into a downward thrust via the force-multiplying portion 41, the engaging balls 40, the receiving portions 38, and the transmitting portions 37. In consequence, the output rod 2 is strongly driven downward.

Figure 3D:
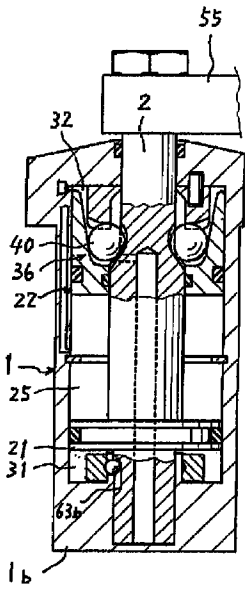

After that, as shown in FIG. 3D (locked state at a final stage of force multiplication driving), the second piston 22 strongly pushes, downward via the engaging balls 40 of the force multiplier 36, the output rod 2 which has been prevented by the workpiece (not illustrated) from moving down. For this reason, a resultant of a downward force exerted by the force multiplier 36 and a downward force exerted by the first piston 21 causes the output rod 2 to strongly press the workpiece against a fixed base (not illustrated) such as table via the clamping member 55.

In a case where the cylinder device is changed from the locked state shown in FIG. 3D to the release state shown in FIG. 3A, (i) the compressed air is discharged out of the lock chamber 25 and (ii) compressed air is supplied into the first release chamber 31 and the second release chamber 32, in the state shown in FIG. 3D. This causes the cylinder device to be changed to the release state by executing the steps of the procedure for lock driving in reverse order.

An angle of inclination of each of the transmitting portions 37 with respect to the axis of the output rod 2 preferably ranges from 20 degrees to 60 degrees, and more preferably ranges from 25 degrees to 45 degrees. An angle of inclination of the force-multiplying portion 41 with respect to the axis of the output rod 2 preferably ranges from 8 degrees to 15 degrees. These points also apply to each of the embodiments which are early described.

The third embodiment can be altered as follows:

The guide mechanism 62 is of course not limited to the exemplified structure. Instead of the exemplified balls 64, cylindrical pins, for example, can be employed as guide members to be fitted in the guide grooves 63. Note that the rotating sleeve 67 can be omitted.

The bottom walls of the grooves, by which bottom walls the receiving portions 38 are constituted, can be constituted by horizontal walls alone.

The third embodiment can be configured so that (i) the output rod 2 has a lower portion projecting downward from the lower end wall 1*b*, (ii) the projecting portion is hermetically inserted in the lower end wall 1*b*, (iii) the projecting portion has its lower part coupled to a detected part via which an operating state of the cylinder device is detected by a sensor which faces the detected part. Examples of the sensor encompass a limit switch.

FIG. 5 shows a modification of the force multiplier 36 and corresponds to the release state shown in the left half of FIG. 4.

In this case, the press portion 48 of the second piston 22 has a circular arc cross-section. Further, each of the receiving portions 38 is constituted by an inclined surface that gets closer to the axis of the output rod 2 as it extends upward.

Furthermore, each of the embodiments and the modification can be altered as follows:

It is possible to provide a return spring, instead of or in addition to the first and second release chambers 31 and 32 each of which is configured so as to supply and discharge a pressurized fluid for releasing.

The first and second release chambers 31 and 32 can be connected to each other using a communicating hole provided in the barrel part 1*c* of the housing 1 or using piping provided outside the housing 1, instead of using the communicating hole 34 provided in the output rod 2.

The number of the transmitting portions 37 which are to be provided circumferentially is preferably three or four, but can be alternatively two or not less than five. Similarly, the number of the receiving portions 38 which are to be provided circumferentially is preferably three or four, but can be alternatively two or not less than five. Furthermore, the transmitting portions 37 can be formed on a surface of a member not having such depressions, instead of being formed in depressions as illustrated above. Similarly, the receiving portions 38 can be formed on a surface of a member not having such grooves, instead of being formed in grooves as illustrated above.

The engaging members 40 are not limited to the engaging balls illustrated above, provided that they engage in the wedge space 39, and can therefore be rollers or the like. The number of the engaging members 40 which are to be provided is preferably three or four, but can be alternatively two or not less than five.

A pressurized fluid to be used in the cylinder device of the present invention can be pressurized gas, pressurized oil, or the like, instead of being pressurized air as exemplified above.

In addition, various alterations can of course be made within a range that a person skilled in the art can envisage.

REFERENCE SIGNS

1: Housing, 1*a* (1*b*): First end wall, 1*b* (1*a*): Second end wall, 2: Output rod, 21: First piston, 22: Second piston, 25: Lock chamber, 31: First release chamber, 32: Second release chamber, 34: Communicating hole, 36: Force multiplier, 37: Transmitting portion, 38: Receiving portion, 39: Wedge space, 40: Engaging member (engaging ball), 41: Force-multiplying portion, 43: Depression, 48: Press portion, 55: Clamping member, 62: Guide mechanism.

The invention claimed is:

1. A cylinder device, having a force multiplier, comprising (i) an output rod (2) inserted in a housing (1) so as to be movable axially, (ii) a first piston (21) coupled to the output rod (2) in the housing (1), (iii) a second piston (22) inserted in the housing (1) radially outside of the output rod (2) so as to be movable axially, and (iv) the force multiplier (36) causing an axial force acting on the second piston (22) to be subjected to force multiplication so as to be transmitted to a transmitting portion (37) of the output rod (2), the force multiplier (36) comprising:

a wedge space (39) which, when force multiplication driving is started by the first piston (21) and the second piston (22) axially moving relative to each other, is formed between the transmitting portion (37) of the output rod (2) and a receiving portion (38) provided in the housing (1) so as to get narrower as it extends radially inward; and engaging members (40) which, before the force multiplication driving is started, are brought into contact with a portion of an outer circumferential surface of the output rod (2) excluding the transmitting portion (37) and which, when the force multiplication driving is started, are pushed out toward the wedge space (39) by the second piston (22).

2. The cylinder device having the force multiplier as set forth in claim 1, wherein:

the second piston (22) is arranged in the housing (1) in tandem with the first piston (21);

the force multiplier (36), during its force multiplication driving, causes (i) a first force, with which the second piston (22) is moved toward a first axial end side, to be reversed to be a second force getting toward a second axial end side and (ii) the second force to be subjected to force multiplication so as to be transmitted to the transmitting portion (37); and the engaging members (40) are configured to be switchable between a state in which the engaging members (40) are engaged on the transmitting portion (37) during the force multiplication driving and a state in which the engaging members (40) are brought into contact with a portion of the outer circumferential surface of the output rod (2) that is closer to the second axial end side than the transmitting portion (37) during a low-load stroke before the force multiplication driving is started.

3. The cylinder device having the force multiplier as set forth claim 2, wherein the plurality of engaging members (40) are inserted at regular intervals circumferentially in the wedge space (39).

4. The cylinder device having the force multiplier as set forth claim 2, wherein the engaging members (40) are balls.

5. The cylinder device having the force multiplier as set forth in claim 2, further comprising:

a lock chamber (25), arranged between the first piston (21) and the second piston (22), into and out of which a pressurized fluid is supplied and discharged, such that the first piston (21) and the second piston (22) are pushed in such directions as to be away from each other;

a first release chamber (31), arranged such that the first piston (21) is pushed toward the second piston (22), into and out of which the pressurized fluid is supplied and discharged; and a second release chamber (32), arranged such that the second piston (22) is pushed toward the first piston (21), into and out of which the pressurized fluid is supplied and discharged.

6. The cylinder device having the force multiplier as set forth in claim 1, wherein:

the second piston (22) is arranged in the housing (1) in tandem with the first piston (21);

the force multiplier (36), during its force multiplication driving, causes (i) a first force, with which the second piston (22) is moved toward a first axial end side, to be reversed to be a second force getting toward a second axial end side and (ii) the second force to be subjected to force multiplication so as to be transmitted to the transmitting portion (37); and the second piston (22) is provided with a press portion (48) for pushing out the engaging members (40) toward the wedge space (39) at a start of the force multiplication driving, the press portion (48) pushing the engaging members (40) radially inward and toward a portion of the outer circumferential surface of the output rod (2) that is closer to the second axial end side than the transmitting portion (37) during a low-load stroke before the force multiplication driving is started.

7. The cylinder device having the force multiplier as set forth in claim 6, wherein the press portion (48) is configured such that a force with which the press portion (48) pushes the engaging members (40) radially inward is smaller than a force with which a force-multiplying portion (41) provided in the second piston (22) pushes the engaging members (40) radially inward.

8. The cylinder device having the force multiplier as set forth claim 6, wherein the plurality of engaging members (40) are inserted at regular intervals circumferentially in the wedge space (39).

9. The cylinder device having the force multiplier as set forth claim 6, wherein the engaging members (40) are balls.

10. The cylinder device having the force multiplier as set forth in claim 6, further comprising:

a lock chamber (25), arranged between the first piston (21) and the second piston (22), into and out of which a pressurized fluid is supplied and discharged, such that the first piston (21) and the second piston (22) are pushed in such directions as to be away from each other;

a first release chamber (31), arranged such that the first piston (21) is pushed toward the second piston (22), into and out of which the pressurized fluid is supplied and discharged; and a second release chamber (32), arranged such that the second piston (22) is pushed toward the first piston (21), into and out of which the pressurized fluid is supplied and discharged.

11. The cylinder device having the force multiplier as set forth in claim 1, wherein the plurality of engaging members (40) are inserted at regular intervals circumferentially in the wedge space (39).

12. The cylinder device having the force multiplier as set forth in claim 1, wherein the engaging members (40) are balls.

13. The cylinder device having the force multiplier as set forth in claim 1, further comprising:

a lock chamber (25), arranged between the first piston (21) and the second piston (22), into and out of which a pressurized fluid is supplied and discharged, such that the first piston (21) and the second piston (22) are pushed in such directions as to be away from each other;

a first release chamber (31), arranged such that the first piston (21) is pushed toward the second piston (22), into and out of which the pressurized fluid is supplied and discharged; and a second release chamber (32), arranged such that the second piston (22) is pushed toward the first piston (21), into and out of which the pressurized fluid is supplied and discharged.

* * * * *